US005938363A

United States Patent [19]

Timms et al.

[11] Patent Number: 5,938,363

[45] Date of Patent: Aug. 17, 1999

[54] LOTION DISPENSING SYSTEM

[76] Inventors: Lisa R. Timms; Henry R. Brown, both of 4155 Balfour Rd., Detroit, Mich. 48224

[21] Appl. No.: 09/110,037

[22] Filed: Jul. 2, 1998

[51] Int. Cl.[6] ..... B43K 7/00

[52] U.S. Cl. ..... 401/209; 401/132; 401/134

[58] Field of Search ..... 401/209, 213, 401/216, 132, 133, 134, 135, 6

[56] References Cited

U.S. PATENT DOCUMENTS

| | | | |
|---|---|---|---|
| 2,837,756 | 6/1958 | Barlow et al. | 401/132 |
| 3,481,676 | 12/1969 | Schwartzman | 401/134 |
| 4,526,490 | 7/1985 | Welsh | 401/183 |
| 4,571,106 | 2/1986 | Scuderi | 401/209 |
| 4,768,688 | 9/1988 | Harrigan | 224/148 |
| 4,889,441 | 12/1989 | Tice | 401/131 |
| 4,961,661 | 10/1990 | Sutton et al. | 401/6 |
| 5,042,690 | 8/1991 | O'Meara | 401/134 |
| 5,360,111 | 11/1994 | Arispe | 206/361 |

*Primary Examiner*—David J. Walczak
*Attorney, Agent, or Firm*—Joseph N. Breaux

[57] ABSTRACT

A lotion dispensing device which includes a lotion dispensing body with a central interior cavity dimensioned to receive replaceable lotion cartridges while the lotion is dispensed from the dispensing device by a piercing dispensing orifice member which includes a piercing flow tube and roller ball spreader applicator assembly which is threadably secured to the dispensing end of the dispensing body of the device. The device also includes a cover member with a retaining clip. The device is dimensioned and constructed similar to a ball point pen and/or marking pen and is easily carried in accessible locations by a user such as a plumber, mechanic and/or machinist.

4 Claims, 1 Drawing Sheet

LOTION DISPENSING SYSTEM

TECHNICAL FIELD

The present invention relates to devices and methods for dispensing lotion and more particularly to devices and methods for dispensing lotion from a compact pen sized lotion dispensing device which may be carried by user in a shirt pocket or notebook which includes replaceable lotion cartridges and a lotion roller ball spreader/applicator which spreads and applies the lotion onto a user's skin.

BACKGROUND ART

The use of body and hand lotions has escalated with the recognition that such lotions have properties desirable for many users. Lotions are also being used by those historically not apt to use such products such as mechanics, plumbers, machinists and the like. Most of these users of lotions are continually on the go and require a lotion dispensing device which is easy to carry, convenient, stored in a readily accessible place, and useful in applying and spreading a lotion to a desired body part. The present invention solves these problems by providing a lotion dispensing device which is easily carried by user in his or her shirt pocket, notebook, purse, or any other handy location for easy access, while the lotion dispensing device is dimensioned similar to a pen and includes an internal cavity for receiving a replaceable lotion cartridge, and a roller spreader which quickly dispenses and spreads lotion on a given area of the user's skin. Furthermore, the device includes a useful clip for securing the lotion dispensing device to a user's pocket and/or notebook thereby preventing the dispensing device from being dropped or inadvertently falling from a user's pocket.

There have been numerous prior art devices for dispensing lotion. Some of the relevant prior art patents are as follows:

Arispe, U.S. Pat. No. 5,360,111 discloses a compact applicator for tanning lotions and the like with a retractable telescoping handle which attaches to an applicator base. This device is extremely useful for a user who would like to apply tanning lotion to inaccessible portions of his or her body. Although this device is extremely useful for applying tanning lotion by a single user, it does not provide a handy easy to use lotion applying device which may be stored in a user's shirt pockets and/or notebook and further providing a roller lotion spreader and dispenser.

Sutton, et al, U.S. Pat. No. 4,961,661 discloses a lotion dispensing lotion applicator which includes a fibrous pad applicator which is saturated with lotion and further including a telescoping handle element to provide access to remote areas of the user's body. This device is also useful for its stated purposes however it does not solve the problem as the present invention which provides a easy to store, and easy to utilize lotion applicator which fits easily into a user's front shirt pocket as the present invention. Tice, U.S. Pat. No. 4,889,441 discloses a combined skin lotion dispenser and applicator which includes a thin walled container providing a manually squeezable means for dispensing the lotion therein to a bottle type applicator covered with a fabric saturating dispenser. This applying device is useful for those who wish to apply lotion at home at there leisure. This device is not adaptable for use for people on the go as the present invention which includes a roller ball spreader applicator allowing the lotion to be dispensed without saturating any portion of the dispensing device which allows the device to be carried and handled in different locations and conditions by the user.

Harrigan, U.S. Pat. No. 4,768,688 discloses a suntan lotion bracelet formed from a tubular body configured in a shape of a ring. This novel device allows sun tanners to have ready access to lotion contained within a bracelet. The present invention differs from the Harrigan in that the user's lotion is provided in a easy to carry dispensing device which is easily carried in a pocket and/or notebook. Additionally, Harrigan requires a person to wear a bracelet, which for some users such as plumbers, mechanics and machinist is impractical and sometimes forbidden.

Scuderi, U.S. Pat. No. 4,571,106 discloses a spherical ball applicator for applying lotion to different parts of the human body. The applicator includes an elongated body shape allowing the applicator to reach inaccessible areas of the user's body. This device is also useful for reaching inaccessible body parts of the user allowing a single user to apply lotion where desired and differs from the present invention in that the present invention is adaptable to be easily carried by a user, and does not include an elongated body shape, which would render its impractical for its stated purpose.

Welsh, U.S. Pat. No. 4,526,490 discloses a dispenser for flowable material having a squeezable container with a combination handle and closure member. The Welsh device is useful for providing a small easy to carry dispenser. The present invention differs from Welsh in that the present invention does not include a squeezable dispensing means. Additionally, the squeezable dispensing arrangement of Welsh would render the present invention inoperable since the contents may be inadvertently dispensed when not desired. The present invention must be able to be carried by a user in a pocket with sufficient confidence by the user that the device won't inadvertently dispense lotion in the user's pocket or any other place where the user may store the dispensing device. The present invention accomplishes this by providing a roller type dispenser and spreader which is only activated when a user contacts the roller ball assembly to the user's skin and purposefully rolls the ball over skin to be covered with lotion. Furthermore the present invention includes a cover member for covering the dispensing roller ball orifice, further preventing inadvertent lotion dispensing.

GENERAL SUMMARY DISCUSSION OF INVENTION

It is thus an object of the invention to provide a lotion dispensing system that allows a use to conveniently carry lotion for personal use in his or her pocket, notebook, or purse.

It is a further object of the invention to provide a lotion dispensing system that will be manufactured in the shape of a pen with a clip on one end so that it may be carried in a user's shirt pocket or clipped to a user's pocketbook and/or notebook furthermore wherein a replaceable lotion cartridge is provided containing hand lotion which would be received by an interior portion of the lotion dispensing device.

It is a still further object of the invention to provide a lotion dispensing system that would allow a user to carry hand lotion for personal use thereby avoiding the use of public hand lotion dispensing facilities which may be unsanitary and/or contaminated.

It is a still further object of the invention to provide a lotion dispensing system that includes lotion package in a replaceable cartridge that are sized to be received into an interior cavity of a lotion dispensing body member, a piercing dispensing orifice member having a piercing tube member adapted for piercing the prepackaged cartridge when the piercing dispensing orifice member is threadably secured onto the end of the dispensing lotion member, a cover member is provided for covering the dispensing orifice and further wherein the dispensing orifice includes a roller ball type spreader and applicator for spreading the lotion onto a user's skin

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that the lotion dispensing device can be utilized with numerous types of hand lotions. When a user desires hand lotion, he or she would simply remove the lotion dispensing device from his or her shirt pocket, notebook or any other handy storage place, remove the cover member and temporary place it onto the opposite end of the dispensing body member, the desired amount of lotion is been rolled out onto a skin location desired by the user with the roller ball spreading applicator. When finished, the cover member is then replaced over the roller ball spreader and applicator and the device is then replaced in the user's pocket or other location. When the lotion cartridge is empty, the user would simply unscrew the piercing dispensing orifice member from the dispensing body threaded portion and remove the interior stored replaceable lotion cartridge from the dispensing body. A new lotion cartridge is then inserted into the dispensing body interior, the piercing dispensing orifice member is then threaded back onto the dispensing body threaded portion, which pierces the new cartridge with a piercing flow tube which has a lotion passageway in communication with the roller ball spreader applicator. The cover member is then placed back onto the dispensing end of the dispensing device and the device is then ready for handy storage for use by the user.

Figure 1:
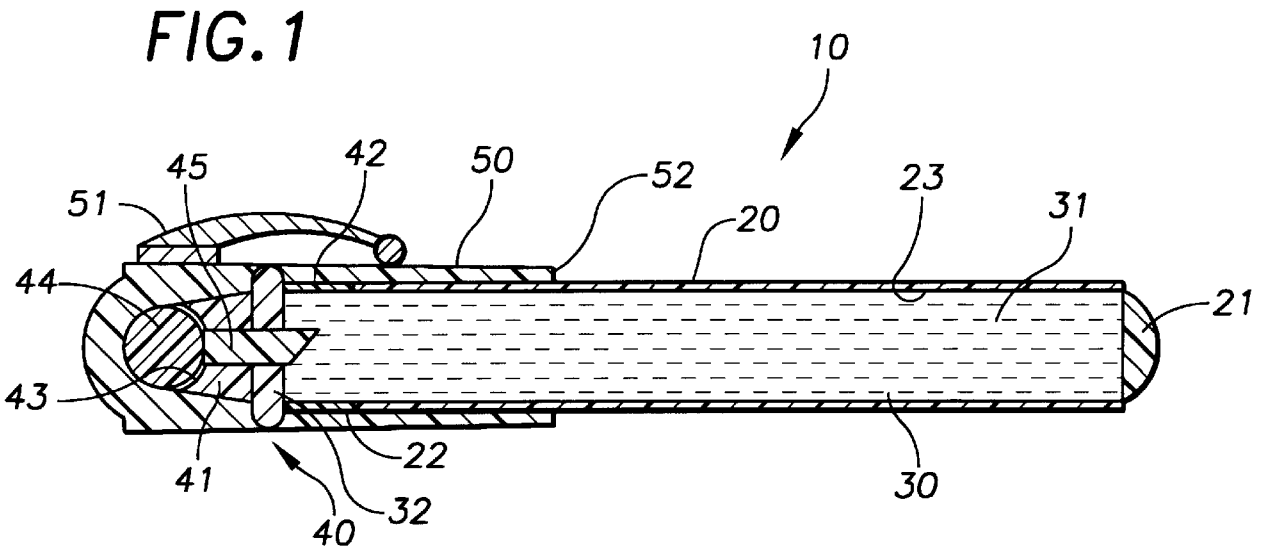
FIG. 1 is a cross-sectional side view of the lotion dispensing device illustrating in detail the dispensing body member, the piercing dispensing orifice member, the replaceable lotion cartridge, and the cover member.
Figure 2:
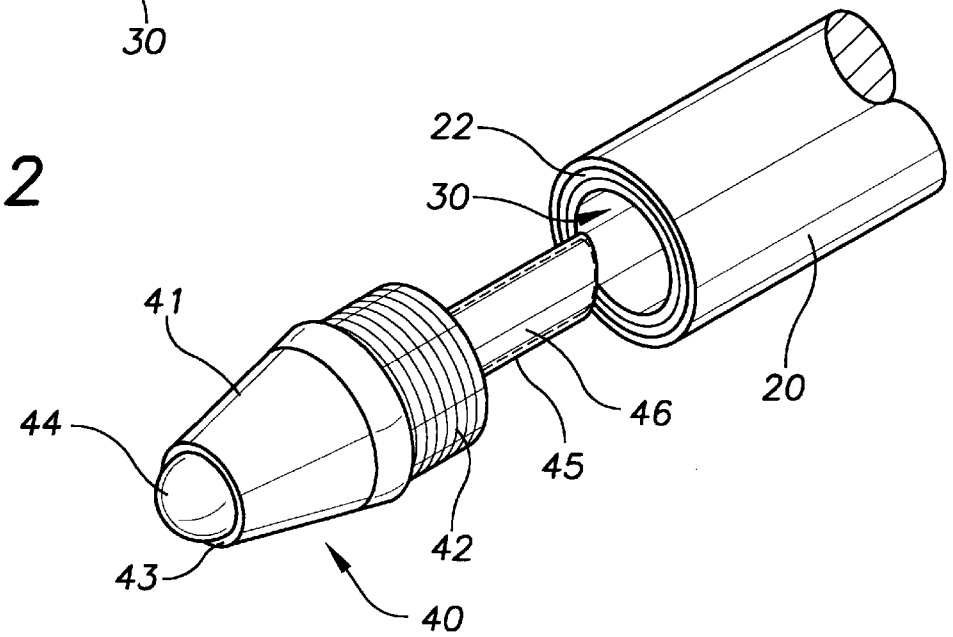
FIG. 2 is a isometric view of the piercing dispensing orifice member and the dispensing body member.

Referring to the figures in detail FIG. 1 illustrates the dispensing device 10 which comprises the main components of the dispensing body 20 the replaceable lotion cartridge 30 the piercing dispensing orifice member 40 and the cover member 50.

The dispensing body 20 is cylindrical in dimension and about the same diameter as a marking pen and preferably about ⅜ to about ½ inch in diameter while the length of the dispensing body 20 is about two to about four inches in length thereby allowing the device 10 to be easily carried by a user in his or her shirt pocket. The dispensing body 20 further includes a sealed back portion 21, an open threaded portion 22, and an interior cavity 23. The interior cavity 23 has an interior diameter slightly larger than the outside diameter of the lotion cartridge 30. This provides for easily removing and replacing the replaceable lotion cartridge 30 within the interior 23 of the dispensing body 20. The dispensing body 20 is further constructed of durable polymer material such as ABS plastic, and may also be constructed of other durable material such as aluminum and/or stainless steel. The end portion 21 of the dispensing body is preferably fixedly secured to the dispensing body 20 and provides an end portion of the dispensing body 20 thereby forming the interior cavity 23.

The piercing dispensing orifice member 40 is comprised of a orifice body 41 which includes a threaded portion 42 and a roller ball retaining portion 43. The roller ball retaining portion 43 pressingly receives roller ball 44 while the threaded portion 42 is threadingly received by the dispensing body threaded portion 22. A piercing flow tube 45 extends centrally from the threaded portion end 42 of the piercing dispensing orifice member 40. The piercing flow tube 45 includes a central lotion passageway 46 which extends from the piercing flow tube 45 to the roller ball 44 proving a passageway for lotion 31 from the replaceable lotion cartridge 30 through the piercing flow tube 45 to the roller ball 44 surface. The piercing flow tube 45 also provides a means for puncturing a dispensing end of the lotion cartridge 30 allowing lotion 31 to flow from the lotion cartridge 30 through the piercing tube 45 and contact the roller ball 44 thereby applying lotion to a user's skin surface. The length of the piercing tube 45 is preferably dimensioned to pierce the lotion cartridge 30 when the piercing dispensing orifice member threaded portion 42 is fully threaded onto the dispensing body threaded portion 22, this prevents lotion from inadvertently being released from the lotion cartridge 30 prior to having the piercing dispensing orifice member 40 fully threaded onto the dispensing body 20. All of the components of the piercing dispensing orifice member constructed similar to a ball point pen. Dimensions between the roller ball 44 and the roller ball retaining portion 43 are sufficiently gaged to allow lotion 31 to exit as the roller ball 44 rolls within the roller ball retaining portion 43.

The lotion dispensing cartridge 30 is cylindrical in shape, and dimensioned to be received within the dispensing body interior 23. The lotion cartridge 30 may be filled with lotion of any brand however the viscosity of the lotion must be sufficiently low to allow the lotion to flow towards the piercing tube 45 upon the influence of gravity. The piercing end of the lotion cartridge 32 is preferably constructed of a plastic membrane and/or aluminum foil membrane which is easily pierced by the piecing flow tube 45 when the piercing dispensing orifice member is threaded onto the dispensing body 20.

Cover member 50 includes retaining clip 51 which is springedly biased to resist movement away from an exterior surface of the cover member 50 so that when material such as paper or fabric is placed between the spring clip 51 and the exterior surface the cover member the clip retains the device on the user's pocket or notebook. The cover member 50 also includes an interior cavity 52 which is dimensioned to snugly receive the piercing dispensing orifice member 40 and the dispensing end of the dispensing body 20. The cover member 50 is further constructed similar to a ball point pen cover and/or a marking pen cover so that when it is removed from the dispensing end of the device it may be placed on the back end 21 of the dispensing body 20 for storage while the dispensing device is in use.

It is noted that the embodiment of the lotion dispensing system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lotion dispensing system comprising:

a) a cylindrical dispensing body with a fixedly secured dispensing body end thereby forming an interior replaceable lotion cartridge cavity within the dispensing body, the dispensing body further comprising a threaded end portion, b) a piercing dispensing orifice member having a threaded and portion threadingly secured to the threaded end portion of the cylindrical dispensing body, the piercing dispensing orifice member further comprising a roller ball retaining portion retaining a roller ball at a dispensing end of the piercing dispensing orifice member, while a piercing flow tube is centrally positioned and protruding from the threaded end portion of the piercing dispensing orifice member wherein a lotion passageway extends from the piercing flow tube to an area around the roller ball and roller ball retaining portion, c) a replaceable lotion cartridge having lotion therein and dimensioned to be received with the interior replaceable lotion cartridge cavity of the dispensing body, the replaceable cartridge further comprising a pierceable membrane end providing a location for the piercing flow tube to pierce the replaceable cartridge when the piercing dispensing orifice member is threaded onto the dispensing threaded end portion, d) a cover member dimensioned to snugly fit over a dispensing end of the piercing dispensing orifice member end and further dimensioned to be temporarily stored on the fixedly secured end of the dispensing body, the cover member further comprising a spring clip biased to resist movement away from an outside surface of the cover member so that when flat material is placed between the clip and the outside surface of the clip the clip springingly secures the device on the flat material.

2. The lotion dispensing system of claim 1, wherein the lotion further comprises lotion with viscosity that allows the flow of lotion from the replaceable lotion cartridge through the lotion passageway and to the roller ball when the device is positioned so that the dispensing end is placed down on a user's skin and the fixedly secured end positioned up.

3. The lotion dispensing system of claim 1, wherein the dispensing body further comprises a dispensing body with an outside diameter of about ⅜ to about ½ inch and a length of about 2 to about 4 inches, thereby allowing the device to easily stored in a user's shirt pocket.

4. The lotion dispensing system of claim 1 wherein the roller ball retaining portion for retaining the roller ball further comprises a roll ball retaining portion with a dimension to loosely receive the roller ball so that lotion which flows from the replaceable lotion cartridge to the roller ball may be dispensed and spread by the roller ball rolling within the roller ball retaining portion.

* * * * *